US010184234B2

(12) United States Patent
Vong

(10) Patent No.: US 10,184,234 B2
(45) Date of Patent: Jan. 22, 2019

(54) DRAIN CLOSER WITH DISENGAGEABLE DRAIN CLEANER

(71) Applicant: Binh Gia Vong, San Diego, CA (US)

(72) Inventor: Binh Gia Vong, San Diego, CA (US)

( * ) Notice: Subject to any disclaimer, the term of this patent is extended or adjusted under 35 U.S.C. 154(b) by 0 days.

(21) Appl. No.: 15/919,048

(22) Filed: Mar. 12, 2018

(65) Prior Publication Data

US 2018/0258623 A1 Sep. 13, 2018

Related U.S. Application Data

(60) Provisional application No. 62/601,110, filed on Mar. 11, 2017.

(51) Int. Cl.
*E03C 1/23* (2006.01)
*E03C 1/302* (2006.01)

(52) U.S. Cl.
CPC ..... *E03C 1/2302* (2013.01); *E03C 1/302* (2013.01)

(58) Field of Classification Search
CPC ..... E03C 1/2302; E03C 1/302; E03C 1/264; E03C 1/262; E03F 9/00; E03F 9/002; E03F 9/005
See application file for complete search history.

(56) References Cited

U.S. PATENT DOCUMENTS

| | | | | | |
|---|---|---|---|---|---|
| 2,506,669 | A * | 5/1950 | Heuacker | E03C 1/264 | 220/86.3 |
| 2,909,788 | A * | 10/1959 | Van Der Bel | E03C 1/264 | 15/104.16 |
| 4,999,858 | A * | 3/1991 | Wu | E03C 1/26 | 15/104.33 |
| 5,003,642 | A * | 4/1991 | Robb | E03C 1/262 | 210/164 |
| 5,267,361 | A * | 12/1993 | Lai | E03C 1/282 | 137/247.51 |
| 6,088,843 | A * | 7/2000 | Francisco | E03C 1/264 | 4/289 |
| 6,487,729 | B2 * | 12/2002 | Delanzo | E03C 1/264 | 4/286 |
| 2008/0276392 | A1 * | 11/2008 | Schultz | E03C 1/126 | 15/104.33 |
| 2016/0040412 | A1 * | 2/2016 | Fetkovich | E03C 1/264 | 4/292 |

* cited by examiner

*Primary Examiner* — Janie Loeppke
(74) *Attorney, Agent, or Firm* — Donn K. Harms

(57) ABSTRACT

A drain closer having a body forming a plug configured for engagement in a drain or sink. The drain closure includes a flexible member translatable through a passage in the body of the plug for snagging hair or fibrous matter within the drain. The flexible member is engageable and disengageable from the plug positioned in the drain by sliding it into and out of the passage running axially through the body of the plug.

18 Claims, 3 Drawing Sheets

DRAIN CLOSER WITH DISENGAGEABLE DRAIN CLEANER

FIELD OF THE INVENTION

This application claims priority to U.S. Provisional Patent Application Ser. No. 62/601,110 filed on Mar. 11, 2017 which is incorporated herein in its entirety by this reference thereto.

The disclosed device relates to drains for sinks. More particularly, it relates to a drain closer device adapted for engagement in a sink drain which includes a disengageable cleaner and de-clogging component which may be removed and reinserted into the drain to clear clogs such as those caused by hair and other elongated debris which tend to clog drains.

BACKGROUND OF THE INVENTION

It is a well known and common problem with modern plumbing, which employs drains for sinks and the like, that clogs will inevitably develop in such drains over time. Such clogging of drains is especially prevalent where the drains are connected to sinks and bathtubs and similar plumbing components.

While some such clogs result from non soluble objects being unintentionally deposited into the drain, typically a more common cause for drain clogging is a build-up of hair and other organic material that is flushed into a drain. There are many devices offered professionals and homeowners to unclog drains on such an occurrence. Such include, flexible plungers, metal plumber's snakes and some particularly caustic choices, such as the many different chemical substances sold in supermarkets and hardware stores which can have unhealthy impacts on the environment when flushed downstream.

For example, there are plunging devices sold which employ fluid pressure which causes a pushing and pulling force to be imparted to the clog to attempt to dislodge it into the sewer system for the home or business. Such work well on clogs which are not fibrous but are not adapt at dislodging hair and the like, and such plungers do not work well when adjoining sink drains converge to a common outlet, since pressure from the plunging will generally communicate to the unclogged adjoining sink.

Another widely employed sink cleaning device uses a metal snake device which elongated from coils of a flexible metal member. Such devices work by forcing a spiral wire on the end of the flexible metal member into the drain in an attempt to fracture or break up a clog through forcing the metal member through the clogging material.

These and other drain cleaning components generally work well to remove clogs in drains formed by material other than hair. In hair clogs, the blocking of the drain generally is positioned within the trap. This is especially true of bathroom drains where, due to constant use, hair strands washed down the drain are entangled in the mechanics within the drain employed to seal and unseal the drain plug in the sink.

Additionally, the above noted mechanical drain cleaning devices and methods, generally require that the drain plug be disengaged from the mechanical components within the sink in order to function effectively. While some flexible member cleaning tools are deployable into a drain without removing the plug or stopper, such an endeavor is fraught with peril since the snaring flexible member can easily break the fragile plastic engagement of the drain plug distal end with the pivoting rod within the drain. Unfortunately, such a mechanical disengagement and drain disassembly, is generally beyond the mechanical abilities of most home and business owners. They thus employ cleaning devices at the risk of damaging the closure actuation system of the drain, or seek the help of a plumber or other drain cleaning professional at a cost in money and time to the sink owner.

The disclosed device herein provides a combination drain plug, engageable to conventional drain pop-up mechanical systems, which also includes a flexible member adapted for removing clogs and hair within the draining. The flexible member is slidably engaged within the drain plug and includes barbs and/or recesses configured to grasp onto hair and other fiberous and enlogated material in the drain and remove it. The flexible member can be repeatedly inserted and removed by a user without the need to dissasemble or disconnect the drain plug from the pivot rod in the drain and actuation lever used to translate the drain plug between a sealed and open configuraton with the sink drain.

The forgoing examples of related art and limitations related therewith in the area of sink clog removing art are intended to be illustrative and not exclusive, and they do not imply any limitations on the drain closer with disengageable drain cleaner described and claimed herein. Various limitations of the related art are already known or will become apparent to those skilled in the art upon a reading and understanding of the specification below and the accompanying drawings.

SUMMARY OF THE INVENTION

In accordance with the objects of the present invention, as embodied and broadly described herein, the disclosed device provides a unique configuration combining a drain plug or drain stopper with a user employable flexible drain cleaner. The drain plug has a body with a first end and extends to a second or distal end. At or adjacent the first end of the body it is configured to form a fluid tight seal with a conventional drain opening. At the distal end of the body of the drain plug, opposite the first end, the body is configured with openings adapted to engage with a conventional pivot rod communicating into the drain which is engaged with an actuator. The actuator is employable by a user to translate the drain plug between an open and sealed positioning within the drain of the sink.

The body of the drain plug adjacent the first end thereof, has an exterior circumferential surface, which is sized to sealably engage with the drain opening of a sink in a closed position. In this closed position the formed seal prevents fluid from the sink from communicating into the drain when the body of the plug is in the sealed position. A seal or gasket may also be positioned at or adjacent the circumferential surface used to seal the drain opening.

The openings formed through the body at or adjacent the distal end thereof, are operatively positioned to allow the engagement of the pivot rod which conventionally extends into drains. Once so engaged, when the actuator projecting above the sink is translated by the user, it moves the plug between the sealed position where the circumferential surface is lowered to contact and seal the drain, to the open position wherein the actuator is moved to raise the circumferential surface and disengage the formed seal by forming a gap.

On the first end of the body of the plug, is located an opening to a passage in the plug which communicates through the body of the plug along or adjacent a center axis of the body of the plug. The passage is shaped and sized to allow translation of a flexible member or rod therethrough such that a projecting portion of the flexible member will extend below or beyond the second end of the body of the plug when the flexible member is in an engaged position with the body of the plug. A stop, positioned at a first end of the flexible member prevents it from passing through the opening to the passage. Preferably, a pivot is positioned at the first end of the flexible member, which allows for a pivoted engagement with gripping portion of the flexible member. This allows for a gripping portion which has a larger area for a compressive gripping contact between a finger and thumb of the user. This gripping portion is sized to allow the finger and thumb of a user to compressibly grip it. This gripping portion is preferably formed as a ring with an aperture therein, which provides the user better grip on the first end of the flexible member to translate the flexible member into and out of the passage through the body.

A cover is provided which is removably engageable with the first end of the body of the plug. An engagement of the cover with the first end of the plug forms a cavity sized to hold the gripping portion of the flexible member therein. Removal of the cover allows the user to contact and grip the gripping portion of the flexible member, and translate it into and out of the passage through the body, and to rotate it while engaged in the passage.

The flexible member has a plurality of snagging areas positioned thereon. These snagging areas may be recesses formed into the edges of the elongated member or projections extending from the side edges of the elongated member, or both. In operation with the cover removed from the first end of the body of the plug, the user may grasp the gripping portion of the elongated member and either translate it in the passage of the body or rotate it therein or both. Such actions cause the snagging areas on the flexible member to snag on hair and other elongated objects blocking the train. Thereafter, the user may translate the elongated flexible member out of its engagement with the passage by sliding it through the passage in the body, to thereby remove the hair or other snagged material which was clogging the drain, and then reinsert the elongated flexible member back through the passage in the body and extending into the drain below.

With respect to the above description, before explaining at least one preferred embodiment of the herein disclosed combination drain sealing and cleaning device in more detail, it is to be understood that the invention is not limited in its application to the details of construction and to the arrangement of the components in the following description or illustrated in the drawings. The combination drain closure and unclogging device herein described and disclosed and depicted in the various modes and combinations is also capable of other embodiments and of being practiced and carried out in various ways which will be obvious to those skilled in the art. Any such alternative configuration, as would occur to those skilled in the art, is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other combination drain sealing and cleaning components and for carrying out the several purposes of the present disclosed device. It is important, therefore, that the claims be regarded as including such equivalent construction and methodology insofar as they do not depart from the spirit and scope of the present invention.

It is an object of the present invention to provide a combination drain plug and cleaning member where the drain plug is adapted to engage with conventional drain actuation components employed in drains such as sink drains and bathtub drains.

It is another object of the present invention to provide such a combination drain plug and drain cleaning member wherein the drain cleaning member is removable and reinsertable through the drain plug without the need to remove the drain plug or disengage it from the actuator.

These and other objects, features, and advantages of the present sink sealing and cleaning invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion.

DETAILED DESCRIPTION OF THE INVENTION

Figure 1:
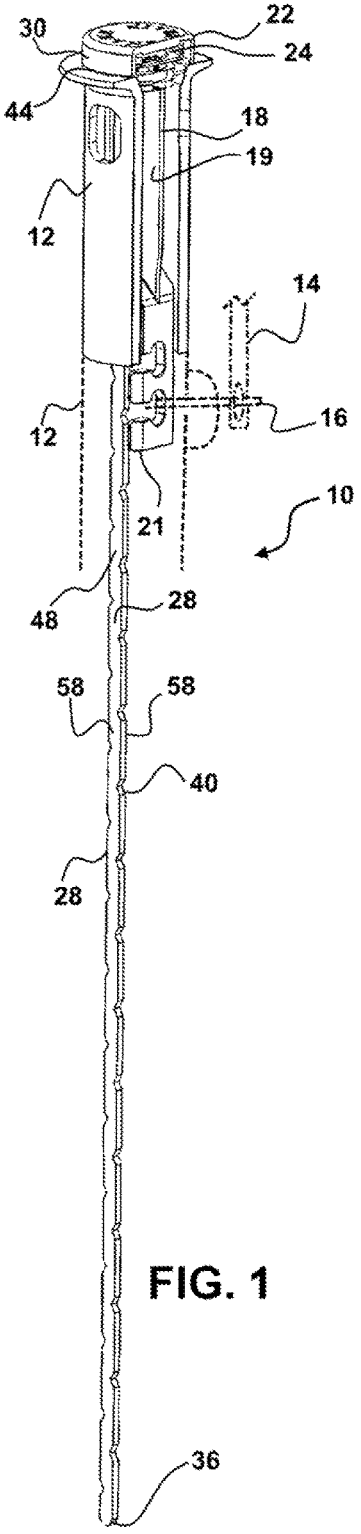
FIG. 1 depicts the combination drain plug and sink cleaning member herein showing the drain plug positioned in a sealed engagement within a sink drain as would occur through actuation of a conventional well-known drain plug actuator, and shows the flexible member engaged through and into the drain.

Now referring to drawings in FIGS. 1-5, wherein similar components are identified by like reference numerals, there is seen in FIG. 1, a depiction of the combination drain plug and sink cleaning device 10 herein, which is configured for operative engagement within a conventional sink or tub drain 12. FIG. 1 is shown for clarity as to such conventional sink and tub drain 12 configurations, and in no manner should be considered limiting.

Figure 2:
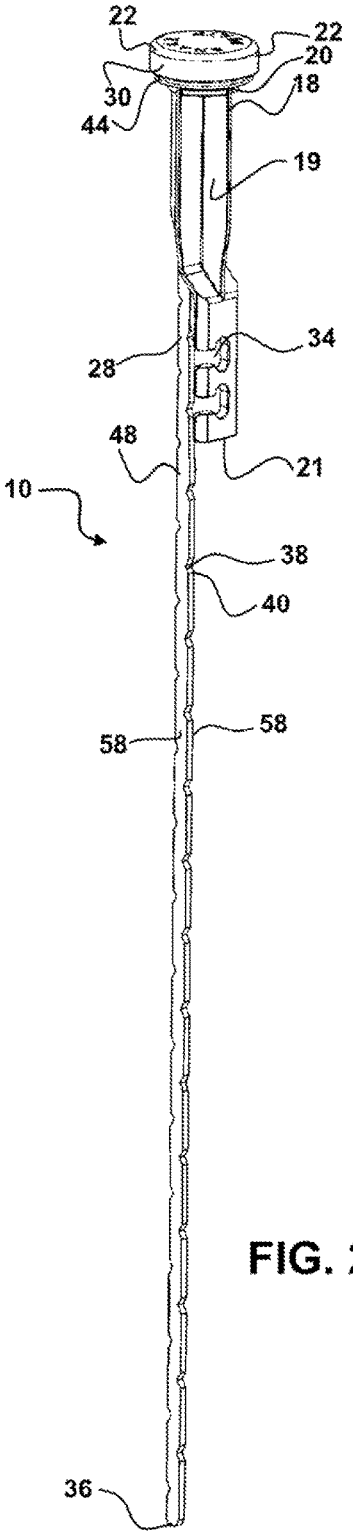
FIG. 2 shows the combination drain plug as shown in FIG. 1 and depicts the flexible member operatively engaged axially through the drain plug at a first end and having a distal end projecting into the drain below.

Referring now to the device 10 as shown in FIGS. 1-2, a body 18 of a plug 19 of the device 10 is configured at a first end 20 for removably engagement of a cap 22 thereon. In the removable engagement of the cap 22 shown in FIGS. 1-2, the cap 22 seals a cavity 24 which is formed at a first end 20 of the body 18. This cavity 24 is sized for holding therein, a gripping portion 26 (FIG. 3) positioned at a first end of a flexible member 28.

Figure 3:
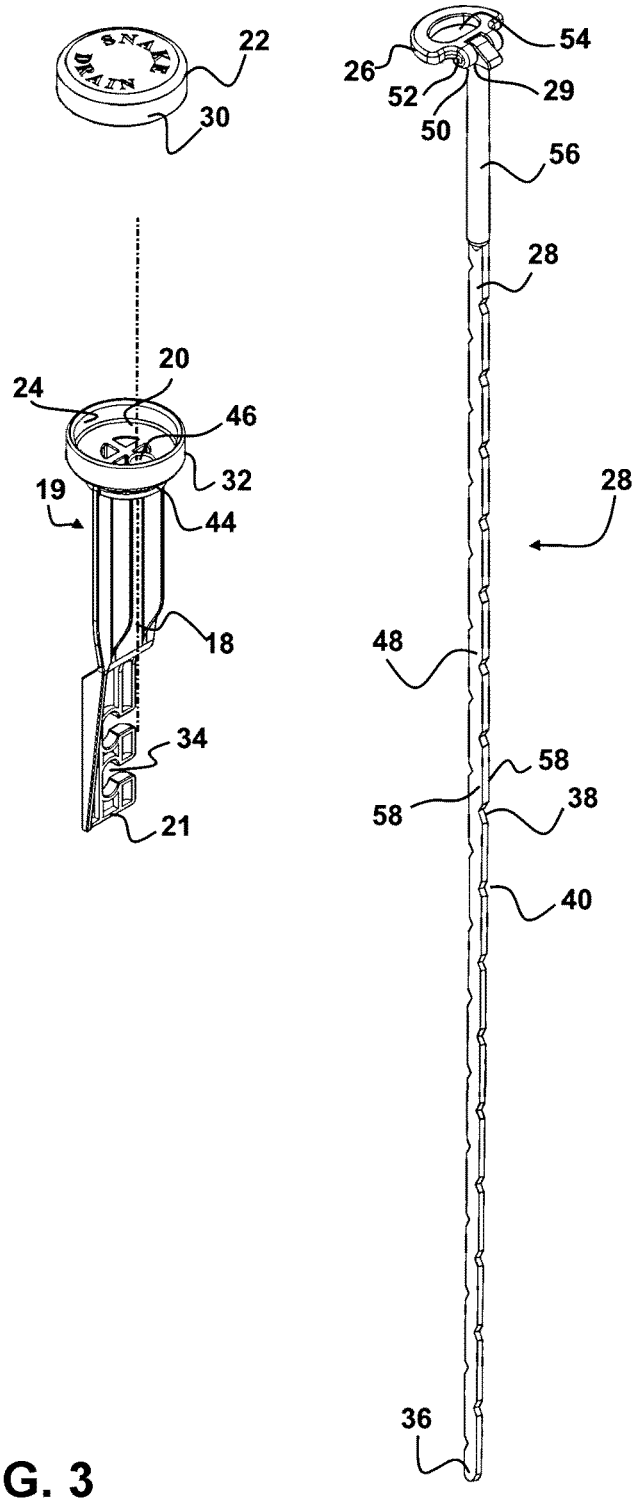
FIG. 3 shows an exploded view of the components of the device herein showing the flexible member removed from engagement through a passage along the shown axis line in the drain plug and showing the openings at or adjacent the distal end of the drain plug configured to engage a conventional sink actuator.

Currently the cap 22 has a removable engagement at or adjacent the first end 20 of the body 18 which is accomplished by a frictional engagement of an interior circumference of a cap sidewall 30 over and against a cavity sidewall 32 (FIG. 3). However, other removable engagements may be employed such as a bayonet type connection or a threaded engagement of the cap to the first end 20 of the body 18, or any other removable engagement as would occur to those skilled in the art to hold the cap 22 in position on the first end 20 of the body 18 covering a cavity 24.

As shown in FIG. 1 where the pivot rod 16 is shown and in FIGS. 2-3, in between the first end 20 and a second end 21 of the body 18 of the plug 19, at least one opening 34 and preferably a plurality of openings 34 communicate through the body 18 of the plug 19. These openings 34 are operatively positioned to allow for the conventional operative connection of a pivot rod 16 that conventionally extends into drains which moves the plug 19 between the sealed position of FIG. 1 and a spaced position allowing fluid flow into the drain 12.

Figure 4:
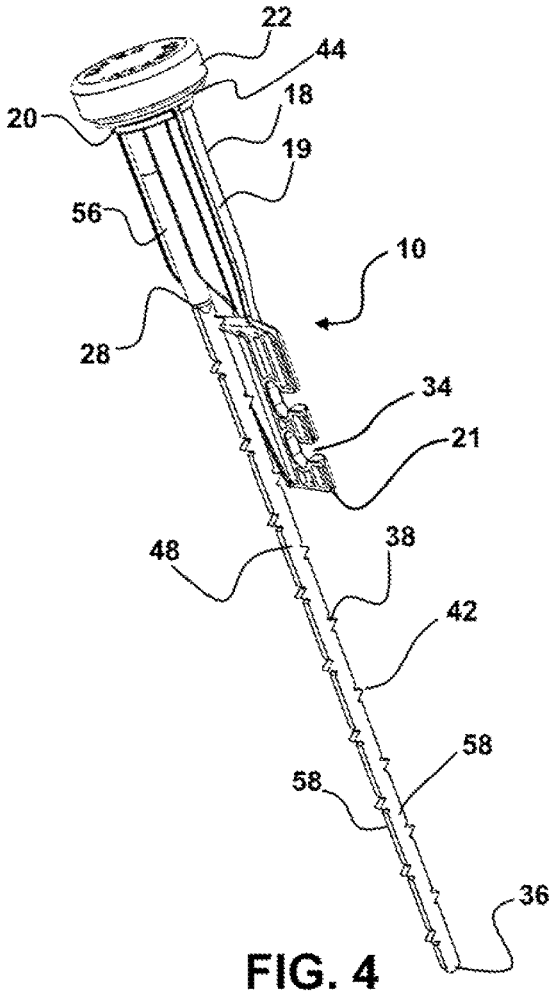
FIG. 4 depicts a perspective view of the sink plug having a flexible cleaning member engaged through the passage in the body forming the sink plug and showing snagging areas formed by barbs for snagging hair and other drain blockages.
Figure 5:
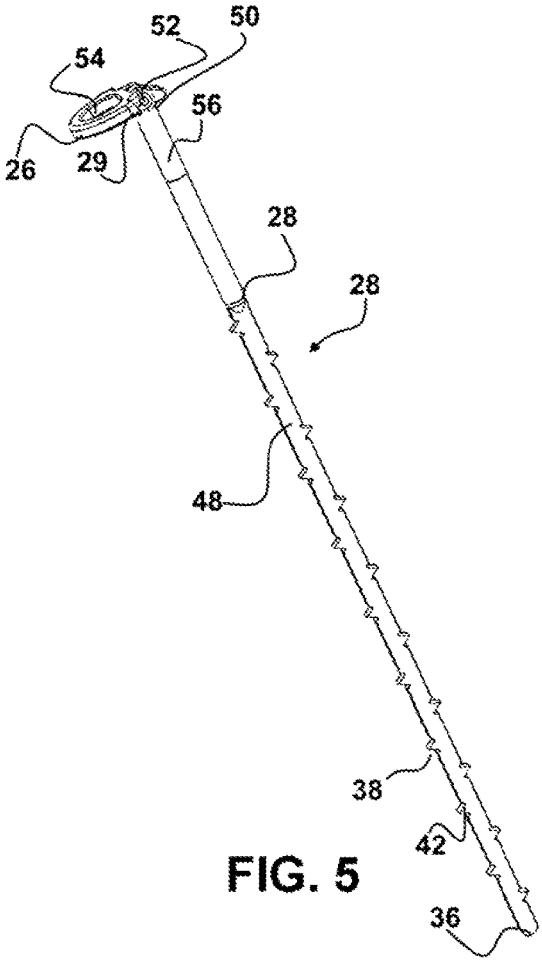
FIG. 5 depicts a perspective view of the flexible member for drain cleaning of FIG. 4 disengaged from the passage in the plug.

The flexible member 28 shown in the engaged position with the plug 19 in FIGS. 1-2 and 4, extends to a distal end 36 from the gripping portion 26 at a first end of the flexible member 28. The body 12 may be formed of metal or more preferably a non corrosive polymeric material. The flexible member 28 is also formed of a polymeric flexible material, preferably with sufficient flexibility to bend through a P-trap situated under most such drains.

As shown in the figures, the flexible member 28 has a plurality of snagging areas 38 positioned sequentially thereon from a position at or adjacent a first end 29 of the flexible member 28 (FIGS. 3 and 5) to the distal end 36 thereof. The snagging areas 38 may either or both of such snagging areas 38 from a group of snagging areas including recesses 40 depending into one or multiple edges of the flexible member 28 and projections 42 extending from one or multiple side edges of the flexible member 28.

As shown in FIGS. 1-3, the body 18 of the drain plug 19 has a seal 44 formed circumferentially around the body 18 adjacent the first end 20 of the body 18. This seal 44 is sized and positioned to compress against and engage with the drain 12 and thereby seal the opening into the drain 12.

As best shown in FIG. 3, on the first end 20 of the body 18 of the plug 19, is located at least passage 46 which communicates through the body 18 of the drain plug 19 along an axis which is adjacent the center axis of the body 18 of the plug 19. This passage 46 is sized for a translation of a flexible member 28 therethrough. As shown in FIGS. 1-2 and 4, for example, this flexible member 28 has a static or engaged position wherein a projecting portion 48 of the flexible member 28, will project and extend below or beyond the second end 21 of the body 18 of the plug 19. In this engaged position, the gripping portion 26 of the flexible member 28 is positioned within the cavity 24 which is covered by the cap 22.

Preferably at a first end 29 of the flexible member 28, a diameter of the flexible member 28 is larger than a diameter of the passage 46, and forms a stop 50 at or adjacent the first end 29 of the flexible member 28. This stop 50 prevents the first end of the flexible member 28 from sliding into and completely through the passage 46. Additionally, while not required for operation, an enhanced grip by a user can be achieved by engaging the gripping portion 26 of the flexible member 28 in a pivoting connection 52 to the first end 29 of the flexible member 28. Still further, formation of the gripping portion 26 as a ring with an aperture 54 therein has shown in experimentation, to yield an enhance means for engagement of the compressing finger and thumb of a user, and would be also preferred, especially when in a pivoting connection 52.

In use, once the cap 22 is disconnected from the removable engagement with the first end 20 of the body 18 of the plug 19, the user will grip the gripping portion 26 positioned at the first end 29 of the flexible member 28, to translate the flexible member 28 into and out of the passage 46 communicating along an axis through the body 18. This allows the user holding the gripping portion 26, to slide the flexible member 28 and the projecting portion 48 thereof, out of the body 18 and drain 12, or back through the body 18 and into the drain 12. Further, with the projecting portion 48 of the flexible member 28 in the engaged position in the drain 12 as in FIG. 1, the user may also grasp the gripping portion 26 of the flexible member 28 and rotate the flexible member 28 and the projecting portion 48 thereof while positioned in the drain. Such translation and rotation as noted above, allows the user to snag and wind and remove hair and other elongated or otherwise flexible objects and remove them from the drain.

Preferably, the diameter of the passage 46 through the body 18, is larger and of a different shape than that of the projecting portion 48 of the flexible member 28. This forms gaps within the passage 46 when the projecting portion 48 of the flexible member 28 is being translated therethrough.

This configuration was arrived at unexpectedly during experimentation when a first portion 56 of the flexible member 28 adjacent the first end 29 thereof, was formed round, and the projecting portion 48 of the flexible member 28 was formed to be more flexible by having planar sides 58 on opposing sides thereof. It was found such a configuration where the planar projecting portions 48 of the flexible member 28 were separated by side edges in a manner which left gaps between the planar sides 58, and the surface defining the shape and size of a larger passage 46, allowed hair and other fibrous or elongated matter blocking the drain, to be wound onto the planar projecting portion 48 of the flexible member 28, and then more easily translated through the passage 46.

As such, the depicted configuration of the projecting portion 48 of the flexible member 28, having sequentially positioned snagging areas 38, along opposing edges thereof which communicate between planar sides 58, and where the separation of the planar sides 58 is such that gaps are formed between the planar sides 58 and the surface defining the passage 46 during translation of the projecting portion 48 therethrough, is preferred.

Further preferred is a shape and diameter of the first portion 56 of the projecting member 28, which is of a diameter larger than that of the projecting portion 48 and of a size and shape which is complimentary to the size and shape of the passage 46. With the first portion 56 being the same shape as the passage 46, all or portions of the circumferential surface of the first portion 56 of the flexible member 28, with will frictionally contact sides of the passage 46 when positioned therein in the engaged or static position. Such a configuration allows the noted easy removal of the projecting portion 48 with wound blockages and concurrently provides better stability to the device 10 when the first portion 56 has some or all of side surfaces thereof frictionally contacting some or all of side surfaces defining the passage 46. Currently, as shown in FIG. 3, a preferred shape for the passage 46 through the body 18 along an axis is round as is the preferred shape of the circumference of the first portion 56 of the flexible member 28. However, other shapes could be employed for both, so long as the passage 46 has an interior perimeter area larger than that of a perimeter of the projecting portion 48, to thereby form gaps between the sides of the passage 46 and the planar sides 58 of the projecting portion 48 of the flexible member 28.

It should be noted, that while the present combination sink closure and cleaning invention has been described herein with reference to particular embodiments thereof and operation thereof, a latitude of modifications, various changes and substitutions are intended in the foregoing disclosures, it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A drain closer adapted for positioning in a drain, comprising:

a drain plug extending from a first end to a second end of a body of said drain plug;

at least one opening in said body of said drain plug at a position between said first end and said second end of said body, said opening adapted for engagement with a pivot rod of a drain in which said drain plug engages;

a passage communicating through said body from a communication of said passage with said first end of said body;

a flexible member extending from a first end having a gripping portion thereon, to a distal end;

said flexible member removably positionable through said passage to an engaged position with said body;

a first position of said flexible member extending into a removable engagement within said passage;

a projecting portion of said flexible member extending past said second end of said body of said drain plug;

said projecting portion of said flexible member having a plurality of snagging areas thereon, said snagging areas adapted to engage with hair located in said drain; and whereby with said drain plug engaged in said drain, said flexible member is removable to thereby pull hair from said drain through said passage.

2. The drain closer adapted for positioning in a drain of claim 1 additionally comprising:

said communication of said passage at said first end of said body positioned in a cavity located at said first end of said body; and a cap, said cap removably engageable to cover said cavity.

3. The drain closer adapted for positioning in a drain of claim 1 additionally comprising:

said projecting portion of said flexible member having a first planar side surface opposite a second planar side surface; and said passage having a diameter wider than a distance of separation of said first planar side surface from said second planar side surface, whereby gaps form between said first planar side surface and said second planar side surface and a sidewall defining said passage when said projecting portion of said flexible member translates through said passage.

4. The drain closer adapted for positioning in a drain of claim 2 additionally comprising:

said projecting portion of said flexible member having a first planar side surface opposite a second planar side surface; and said passage having a diameter wider than a distance of separation of said first planar side surface from said second planar side surface, whereby gaps form between said first planar side surface and said second planar side surface and a sidewall defining said passage when said projecting portion of said flexible member translates through said passage.

5. The drain closer adapted for positioning in a drain of claim 1 wherein said snagging areas are one or a combination of snagging components from a group including projections extending from said projecting portion of said flexible member and recesses depending into said projecting portion of said flexible member.

6. The drain closer adapted for positioning in a drain of claim 2 wherein said snagging areas are one or a combination of snagging components from a group including projections extending from said projecting portion of said flexible member and recesses depending into said projecting portion of said flexible member.

7. The drain closer adapted for positioning in a drain of claim 3 wherein said snagging areas are one or a combination of snagging components from a group including projections extending from said projecting portion of said flexible member and recesses depending into said projecting portion of said flexible member.

8. The drain closer adapted for positioning in a drain of claim 4 wherein said snagging areas are one or a combination of snagging components from a group including projections extending from said projecting portion of said flexible member and recesses depending into said projecting portion of said flexible member.

9. The drain closer adapted for positioning in a drain of claim 1 additionally comprising:

said gripping portion pivotally engaged to said first end of said flexible member.

10. The drain closer adapted for positioning in a drain of claim 2 additionally comprising:

said gripping portion pivotally engaged to said first end of said flexible member.

11. The drain closer adapted for positioning in a drain of claim 3 additionally comprising:

said gripping portion pivotally engaged to said first end of said flexible member.

12. The drain closer adapted for positioning in a drain of claim 4 additionally comprising:

said gripping portion pivotally engaged to said first end of said flexible member.

13. The drain closer adapted for positioning in a drain of claim 5 additionally comprising:

said gripping portion pivotally engaged to said first end of said flexible member.

14. The drain closer adapted for positioning in a drain of claim 9 additionally comprising:

said gripping portion formed as a ring with an aperture communicating therethrough.

15. The drain closer adapted for positioning in a drain of claim 10 additionally comprising:

said gripping portion formed as a ring with an aperture communicating therethrough.

16. The drain closer adapted for positioning in a drain of claim 11 additionally comprising:

said gripping portion formed as a ring with an aperture communicating therethrough.

17. The drain closer adapted for positioning in a drain of claim 12 additionally comprising:

said gripping portion formed as a ring with an aperture communicating therethrough.

18. The drain closer adapted for positioning in a drain of claim 13 additionally comprising:

said gripping portion formed as a ring with an aperture communicating therethrough.

* * * * *